US011326537B2

(12) United States Patent
Katou et al.

(10) Patent No.: US 11,326,537 B2
(45) Date of Patent: May 10, 2022

(54) INJECTION CONTROL DEVICE

(71) Applicant: DENSO CORPORATION, Kariya (JP)

(72) Inventors: Yuuta Katou, Kariya (JP); Kosuke Kato, Kariya (JP); Masashi Inaba, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/357,228

(22) Filed: Jun. 24, 2021

(65) Prior Publication Data

US 2021/0404404 A1 Dec. 30, 2021

(30) Foreign Application Priority Data

Jun. 29, 2020 (JP) ..... JP2020-111592

(51) Int. Cl.
*F02D 41/20* (2006.01)

(52) U.S. Cl.
CPC ..... *F02D 41/20* (2013.01); *F02D 2041/202* (2013.01)

(58) Field of Classification Search
CPC ..... F02D 41/20; F02D 2041/202
See application file for complete search history.

(56) References Cited

U.S. PATENT DOCUMENTS

| | | | | |
|---|---|---|---|---|
| 10,280,864 | B2 * | 5/2019 | Yanoto | F02D 41/401 |
| 11,181,067 | B1 * | 11/2021 | Kato | F02D 41/38 |
| 11,181,068 | B1 * | 11/2021 | Kato | F02D 41/20 |
| 2020/0284214 | A1 * | 9/2020 | Inaba | F02D 41/40 |
| 2021/0372340 | A1 * | 12/2021 | Suganuma | F02D 41/221 |

FOREIGN PATENT DOCUMENTS

JP 2016033343 A 3/2016

* cited by examiner

*Primary Examiner* — Sizo B Vilakazi
(74) *Attorney, Agent, or Firm* — Posz Law Group, PLC

(57) ABSTRACT

An injection control device includes: an area correction unit that calculates an energization time correction amount when executing a current drive of a fuel injection valve to inject a fuel from the fuel injection valve; a charging circuit that applies an electric power from the charging unit to the fuel injection valve; and a charge amount determination unit for determining the charge amount of the charging unit. The area correction unit changes the area correction control based on a determination result of the charge amount determination unit.

6 Claims, 8 Drawing Sheets

INJECTION CONTROL DEVICE

CROSS REFERENCE TO RELATED APPLICATION

The present application claims the benefit of priority from Japanese Patent Application No. 2020-111592 filed on Jun. 29, 2020. The entire disclosure of the above application is incorporated herein by reference.

TECHNICAL FIELD

The present invention relates to an injection control device that controls opening and closing of a fuel injection valve.

BACKGROUND

An injection control device is used to inject fuel into an internal combustion engine by opening and closing a fuel injection valve. In recent years, due to tightening of regulations for environmental problems, further improvement in the fuel injection accuracy in automobiles has been required as measures to improve fuel efficiency and reduce the amount of harmful substance emission. The injection control device opens the fuel injection valve that is electrically drivable by passing current to the fuel injection valve. In recent years, a nominal current profile (also referred to as an ideal current profile) for energization current based on a command injection quantity has been set, and the injection control device opens the fuel injection valve by applying current to the fuel injection valve on the basis of the nominal current profile.

SUMMARY

According to an example embodiment, an injection control device includes: an area correction unit that calculates an energization time correction amount when executing a current drive of a fuel injection valve to inject a fuel from the fuel injection valve; a charging circuit that applies an electric power from the charging unit to the fuel injection valve; and a charge amount determination unit for determining the charge amount of the charging unit. The area correction unit changes the area correction control based on a determination result of the charge amount determination unit.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

If the gradient of the energization current of the fuel injection valve becomes lower than the gradient of the ideal current profile due to various factors such as a peripheral temperature environment and aged deterioration, an actual injection quantity may be largely reduced from the command injection quantity, which may result in deterioration of an A/F value and accidental fire. In order to prevent such problems, it is desirable to previously adjust an energization command time for energization to the fuel injection valve to a rather long time factoring in variations. However, if the rather long energization command time is ensured, the fuel efficiency may be reduced.

In view of this, the applicant of the present application proposes a technique that compensates the fuel injection amount by correcting the energization time on the basis of an integrated current difference between an integrated current of the ideal current profile serving as a target current to reach a target peak current and an integrated current of detected current. However, if the required S/N cannot be secured, for example, in the A/D conversion process of the detected current, the fuel correction amount may be erroneously corrected.

In view of the above points, an injection control device is provided to be capable of appropriately maintaining fuel injection accuracy even when the fuel injection amount correction technique cannot sufficiently exert its effect.

According to an aspect of the present embodiments, an area correction unit calculates an energization time correction amount by performing area correction on a current flowing through a fuel injection valve in current-driving the fuel injection valve to cause the fuel injection valve to inject fuel. Further, the charging circuit is provided with a charging unit, and electric power is applied from the charging unit to the fuel injection valve.

Since the upper limit guard value setting unit sets the upper limit guard value of the energization time correction amount according to the charge amount charged to the charging part of the charging circuit, the energization time correction amount may be changed according to the magnitude of the charge amount. Thus, it is possible to supplement the performance of the fuel injection amount correction technology. As a result, the fuel injection accuracy can be appropriately maintained even if the fuel injection amount correction technique cannot sufficiently exert its effect.

Figure 1:
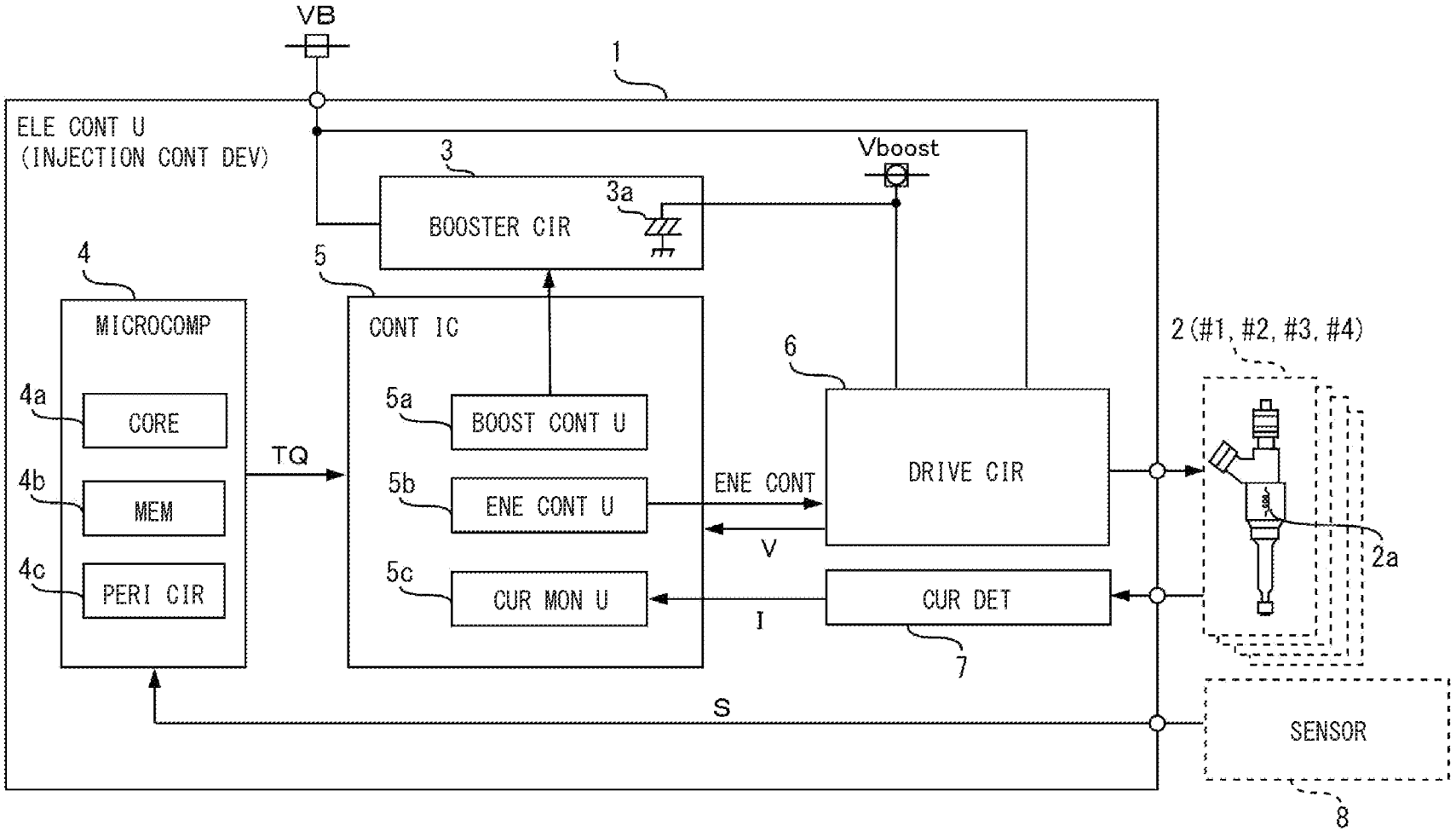
FIG. 1 is the electrical configuration diagram of an injection control device in a first embodiment.

Hereinbelow, an embodiment of an injection control device will be described with reference to the drawings. As illustrated in FIG. 1, an electronic control unit (ECU) 1 is configured as, for example, an injection control device which drives a solenoid fuel injection valve 2 (also called an injector). The fuel injection valve 2 directly injects fuel into an internal combustion engine mounted on a vehicle such as an automobile. Hereinbelow, a mode in which the present invention is applied to the electronic control unit 1 for gasoline engine control will be described. However, the present invention may also be applied to an electronic control unit for diesel engine control. FIG. 1 illustrates the fuel injection valves 2 for four cylinders. However, the present invention can also be applied to three cylinders, six cylinders, or eight cylinders.

As illustrated in FIG. 1, the electronic control unit 1 has an electrical configuration including a booster circuit 3, a microcomputer 4, a control IC 5, a drive circuit 6, and a current detector 7. The microcomputer 4 includes one or more cores 4*a*, a memory 4*b* such as a ROM and a RAM, and a peripheral circuit 4*c* such as an A/D converter, and performs various control operations in accordance with a program stored in the memory 4*b* and sensor signals S acquired from various sensors 8.

Although not illustrated, the sensors 8 for a gasoline engine include, for example, a crank angle sensor which outputs a pulse signal every time a crank shaft rotates by a predetermined angle, a water temperature sensor which detects the temperature of an engine cooling water, a fuel pressure sensor which detects the pressure of fuel injected into the engine, an intake amount sensor which detects the amount of intake air, an A/F sensor which detects an air-fuel ratio, that is, an A/F value of the internal combustion engine, and a throttle opening sensor which detects a throttle opening.

The microcomputer 4 calculates an engine speed from the pulse signal of the crank angle sensor and acquires the throttle opening from a throttle opening signal. The microcomputer 4 calculates a target torque required for the internal combustion engine on the basis of the throttle opening, a hydraulic pressure, and the A/F value, and calculates a required injection quantity serving as a target on the basis of the target torque.

The microcomputer 4 calculates an energization command time Ti of an instruction TQ on the basis of the required injection quantity serving as a target and the fuel pressure detected by the fuel pressure sensor. The microcomputer 4 calculates injection start instruction time t0 for each of cylinders #1 to #4 on the basis of the sensor signals S input thereto from the various sensors 8 described above and outputs the instruction TQ for fuel injection to the control IC 5 at the injection start instruction time t0.

The control IC 5 is an integrated circuit device such as an ASIC and includes, for example, a logic circuit, a control main body such as a CPU, a storage unit such as a RAM, a ROM, or an EEPROM, and a comparator (all of which are not illustrated). The control IC 5 is configured to execute various control operations using hardware and software. The control IC 5 has functions of a boost control unit 5*a*, an energization control unit 5*b*, and a current monitoring unit 5*c*.

Figure 2:
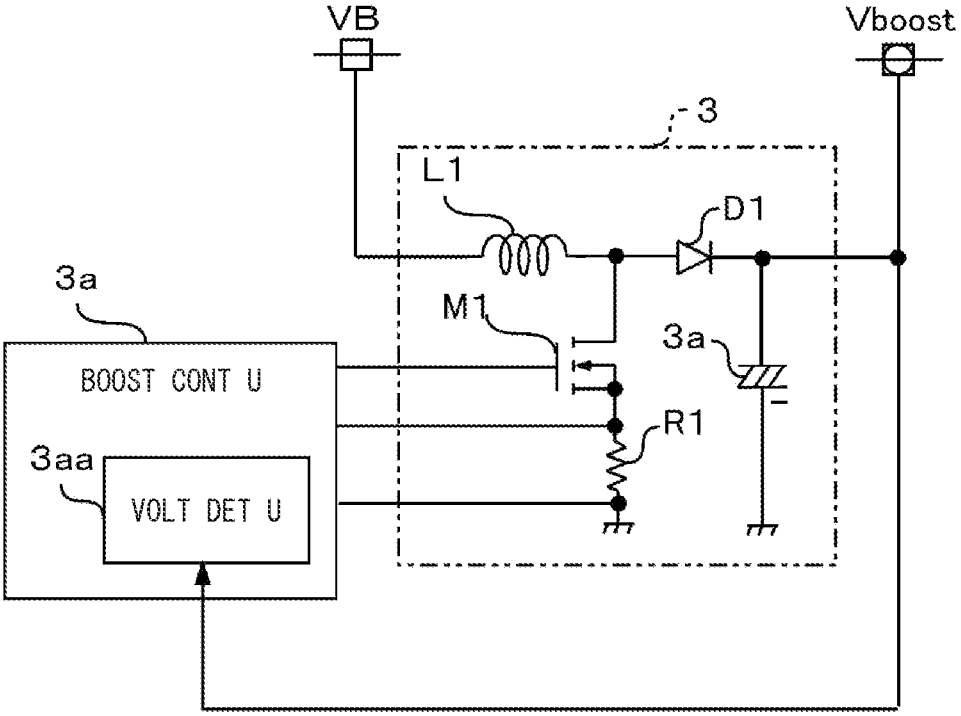
FIG. 2 is the electrical configuration diagram of a booster circuit.

As illustrated in FIG. 2, the booster circuit 3 includes a boost DC-DC converter including an inductor L1, a switching element M1, a diode D1, a current detection resistor R1, and a charging capacitor 3*a* which are connected to each other as illustrated in FIG. 2. The booster circuit 3 receives battery voltage VB input thereto, boosts the battery voltage VB, and charges the charging capacitor 3*a* as a charging unit with a boost voltage Vboost. The boost control unit 5*a* boost-controls the battery voltage VB input to the booster circuit 3 by applying a boost control pulse to the switching element M1. The boost control unit 5*a* detects the boost voltage Vboost in the charging capacitor 3*a* of the booster circuit 3 using a voltage detection unit 3*aa*, charges the charging capacitor 3*a* with the boost voltage Vboost up to a full charge voltage, and supplies the boost voltage Vboost to the drive circuit 6. The charging capacitor 3*a* holds power to be supplied to the fuel injection valves 2 which directly inject fuel into the respective cylinders #1 to #4.

The battery voltage VB and the boost voltage Vboost are input to the drive circuit 6. Although not illustrated, the drive circuit 6 includes, for example, a transistor for applying the boost voltage Vboost to the solenoid coils 2*a* of the fuel injection valves 2 of the cylinders #1 to #4, a transistor for applying the battery voltage VB to the solenoid coils 2*a*, and a cylinder selection transistor which selects the cylinder to be energized. The drive circuit 6 selectively applies the boost voltage Vboost or the battery voltage VB to the solenoid coil 2*a* of the fuel injection valve 2 of each cylinder in accordance with energization control of the energization control unit 5*b* of the control IC 5, thereby driving the fuel injection valve 2 to cause the fuel injection valve 2 to inject fuel.

When the energization control unit 5*b* causes the fuel injection valve 2 to perform partial-lift injection through the drive circuit 6, the energization control unit 5*b* executes an injection process of applying the boost voltage Vboost to the solenoid coil 2*a* of the fuel injection valve 2 and closing the fuel injection valve 2 before the valve is completely opened. When the fuel injection valve 2 performs normal injection, the energization control unit 5*b* applies the boost voltage Vboost to the solenoid coil 2*a* of the fuel injection valve 2 through the drive circuit 6 and then applies the battery voltage VB thereto to perform constant current control, and stops the energization after the elapse of the energization command time Ti. Accordingly, at the normal injection, an injection process of closing the fuel injection valve 2 after the valve is completely opened is executed. The current detector 7 includes a current detection resistor connected to an energization path of the solenoid coil 2*a* of the fuel injection valve 2 of each of the cylinders #1 to #4. The current monitoring unit 5*c* of the control IC 5 includes, for example, a comparator and an A/D converter (both of which are not illustrated), and monitors a current flowing through the fuel injection valve 2 by the current detector 7.

Figure 3:
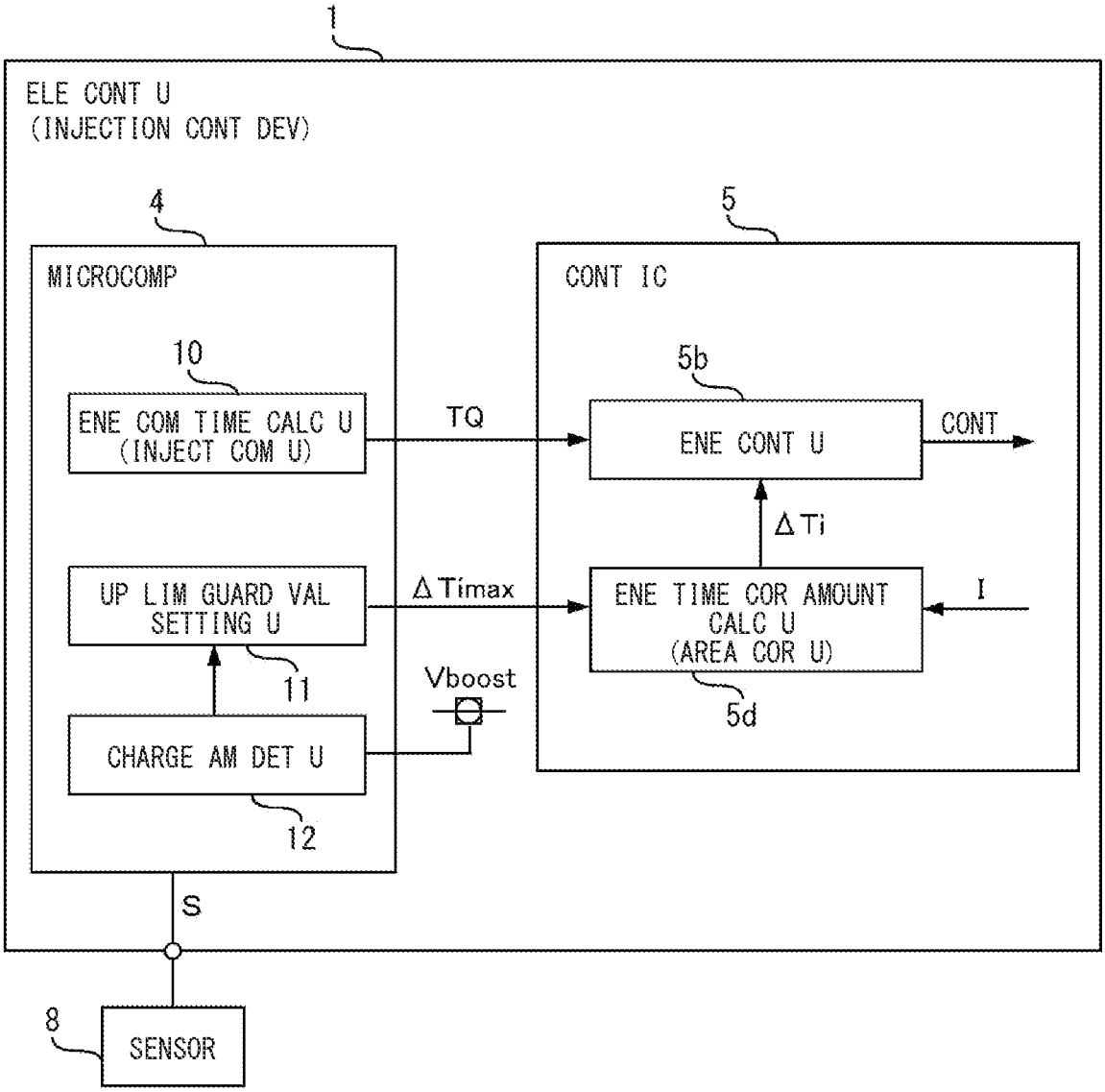
FIG. 3 is an explanatory diagram of information communicated between a microcomputer and a control IC.

FIG. 3 schematically illustrates the functional configuration of the microcomputer 4 and the control IC 5. The microcomputer 4 operates as an energization command time calculation unit 10, an upper limit guard value setting unit 11, and a charge amount determination unit 12 when the core 4*a* executes a program stored in the memory 4*b*. The control IC 5 also has a function of an energization time correction amount calculation unit 5*d* serving as the area correction unit in addition to the functions of the boost control unit 5*a*, the energization control unit 5*b*, and the current monitoring unit 5*c* described above.

The energization command time calculation unit 10 calculates the required injection amount in each cylinder based on the sensor signals S of the various sensors 8. The charge amount determination unit 15 of the microcomputer 4 directly acquires the boost voltage Vboost of the charging capacitor 3*a* of the booster circuit 3 from the control IC 5 to determine the charge amount. At this time, the charge amount determination unit 15 of the microcomputer 4 may directly acquire the charge amount information of the boost voltage Vboost via a step-down circuit (not shown), or acquire the charge amount information of the boost voltage Vboost from the control IC 5. The charge amount determination unit 12 may independently estimate the charge amount to be charged in the charging capacitor 3*a* of the booster circuit 3 as the charging circuit. The charge amount determination unit 12 of the microcomputer 4 preferably estimates the charge amount of the booster circuit 3 on the basis of the information of the required injection quantity described above or information of the battery voltage VB or the like.

The microcomputer 4 calculates the energization command time Ti of the instruction TQ of each cylinder, and commands the energization control unit 5*b* of the control IC 5. When the energization instruction time Ti is input on the control IC 5 side, the energization time correction amount calculation unit 5*d* calculates the energization time correction amount ΔTi for each injection and corrects the energization instruction time Ti commanded by the microcomputer 4 in real time. At this time, it may be difficult for the microcomputer 4 side to grasp the energization time correction amount ΔTi calculated on the control IC 5 side in real time.

In order to prevent overcorrection of the energization time correction amount ΔTi while preventing abnormal control by the control IC 5, the microcomputer 4 sets the upper limit guard value ΔTimax of the energization time correction amount ΔTi in advance by the upper limit guard value setting unit 11 and instructs the value ΔTimax to the control IC5. At this time, the upper limit guard value setting unit 11 of the microcomputer 4 sets the upper limit guard value ΔTimax of the energization time correction amount ΔTi according to the charge amount determined by the charge amount determination unit 12.

The energization command time calculation unit 10 calculates the required injection amount for each cylinder at the start of injection control to a plurality of cylinders based on the sensor signals S of various sensors 8, and calculates the energization instruction time Ti of the instruction TQ to each cylinder. The energization instruction time Ti of the instruction TQ indicates the time for instructing the application of the voltage to the solenoid coil 2*a* of the fuel injection valve 2 of each cylinder during the injection control of each cylinder. The instruction TQ is given to the energization control unit 5*b* of the control IC 5, and the upper limit guard value ΔTimax is given to the energization time correction amount calculation unit 5*d*.

When the instruction TQ is input, the energization control unit 5*b* of the control IC 5 energizes and controls the boost voltage Vboost from the drive circuit 6 to the fuel injection valve 2. On the other hand, when the energization control unit 5*b* current-drives the fuel injection valve 2 to cause the fuel injection valve 2 to inject fuel, the energization time correction amount calculation unit 5*d* of the control IC 5 acquires a current flowing through the fuel injection valve 2 and performs area correction on the current, thereby acquiring an energization time correction amount ΔTi.

The energization time correction amount calculation unit 5*d* feeds back the calculated energization time correction amount ΔTi to the energization control unit 5*b*. The energization control unit 5*b* energizes the fuel injection valve 2 by reflecting the energization time correction amount ΔTi in real time with respect to the energization command time of the input instruction TQ.

Hereinafter, a method of setting the upper limit guard value ΔTimax executed by the microcomputer 4 and an area correction control method executed by the control IC 5 will be described.

When the battery voltage VB is applied to the electronic control unit 1, the microcomputer 4 and the control IC 5 are activated. The boost control unit 5*a* of the control IC 5 outputs the boost control pulse to the boost circuit 3 to accumulate the boost voltage Vboost in the charging capacitor 3*a* of the boost circuit 3. A boost voltage Vboost is charged in the charging capacitor 3*a*. The boost voltage Vboost is charged to a predetermined boost completion voltage that exceeds the battery voltage VB.

The energization command time calculation unit 10 of the microcomputer 4 calculates the required injection amount at the start of energization of the peak current control at the injection start instruction time t0 of the energization command, calculates the instruction TQ, and outputs the instruction TQ to the energization control unit 5*b* of the control IC 5. That is, the microcomputer 4 outputs the energization command time Ti to the control IC 5 through the instruction TQ.

Figure 4:
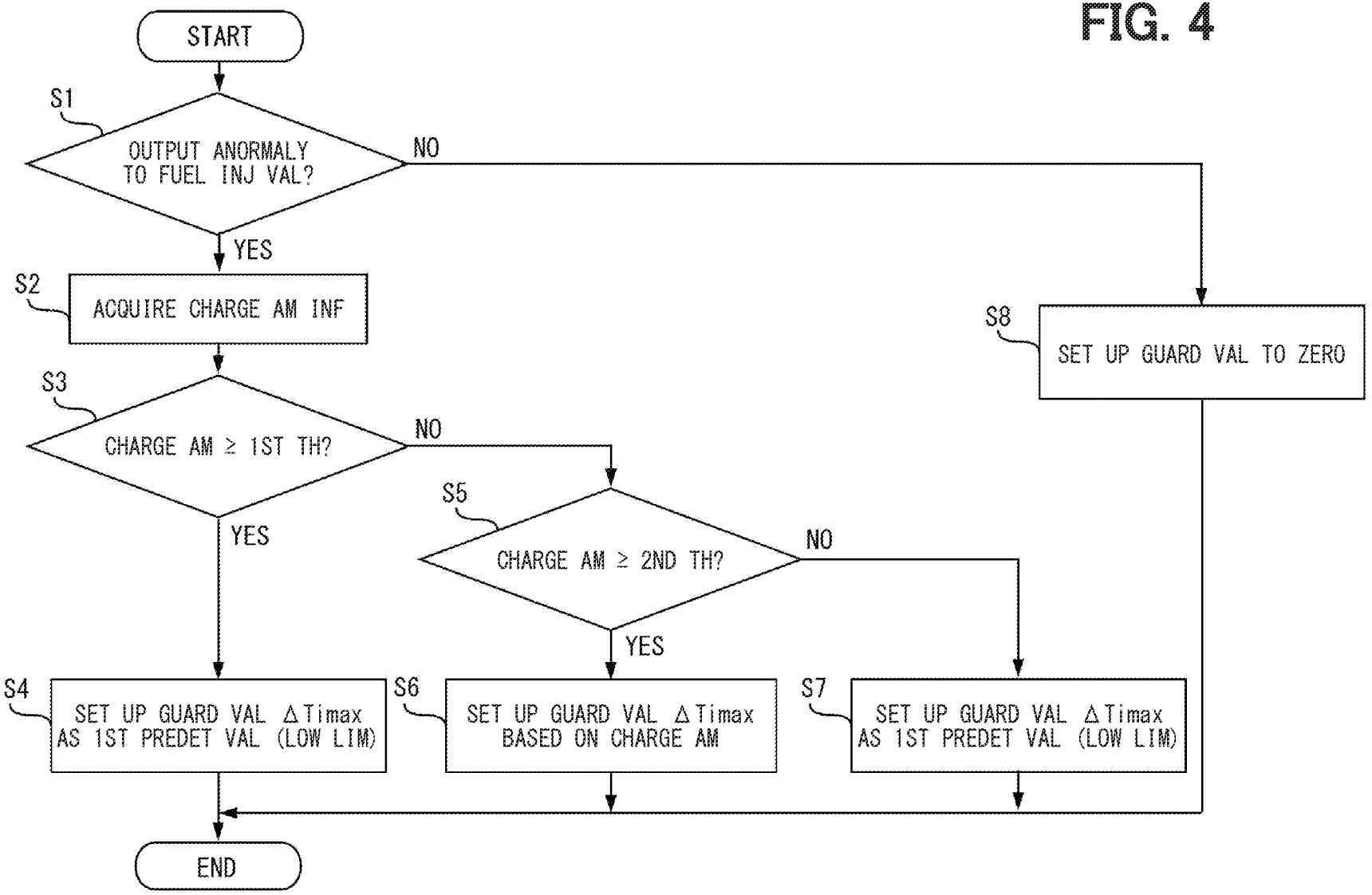
FIG. 4 is a flowchart illustrating an operation schematically.

When the microcomputer 4 commands the control IC 5 to output the energization instruction time Ti of the instruction TQ of each cylinder, both commands the upper limit guard value ΔTimax to the control IC 5. Prior to this command, the processing shown in FIG. 4 is executed. The microcomputer 4 determines whether or not to perform the area correction control of the current by the energization time correction amount calculation unit 5*d*. At this time, the microcomputer 4 determines in S1 whether or not there is an output abnormality to the fuel injection valve 2. If an abnormal output is output to the fuel injection valve 2, it is determined that the area correction control by the control IC 5 is unnecessary, and the upper limit guard value ΔTimax is set to zero. As a result, the area correction control itself is invalidated, and future area correction processing by the control IC 5 is stopped. After that, fail-safe control is performed, but the description thereof will be omitted. Further, instead of the processing of S1, it may be determined whether or not an output abnormality of the A/F sensor (not shown) has occurred to determine whether or not to perform the area correction control of the current.

Figure 5:
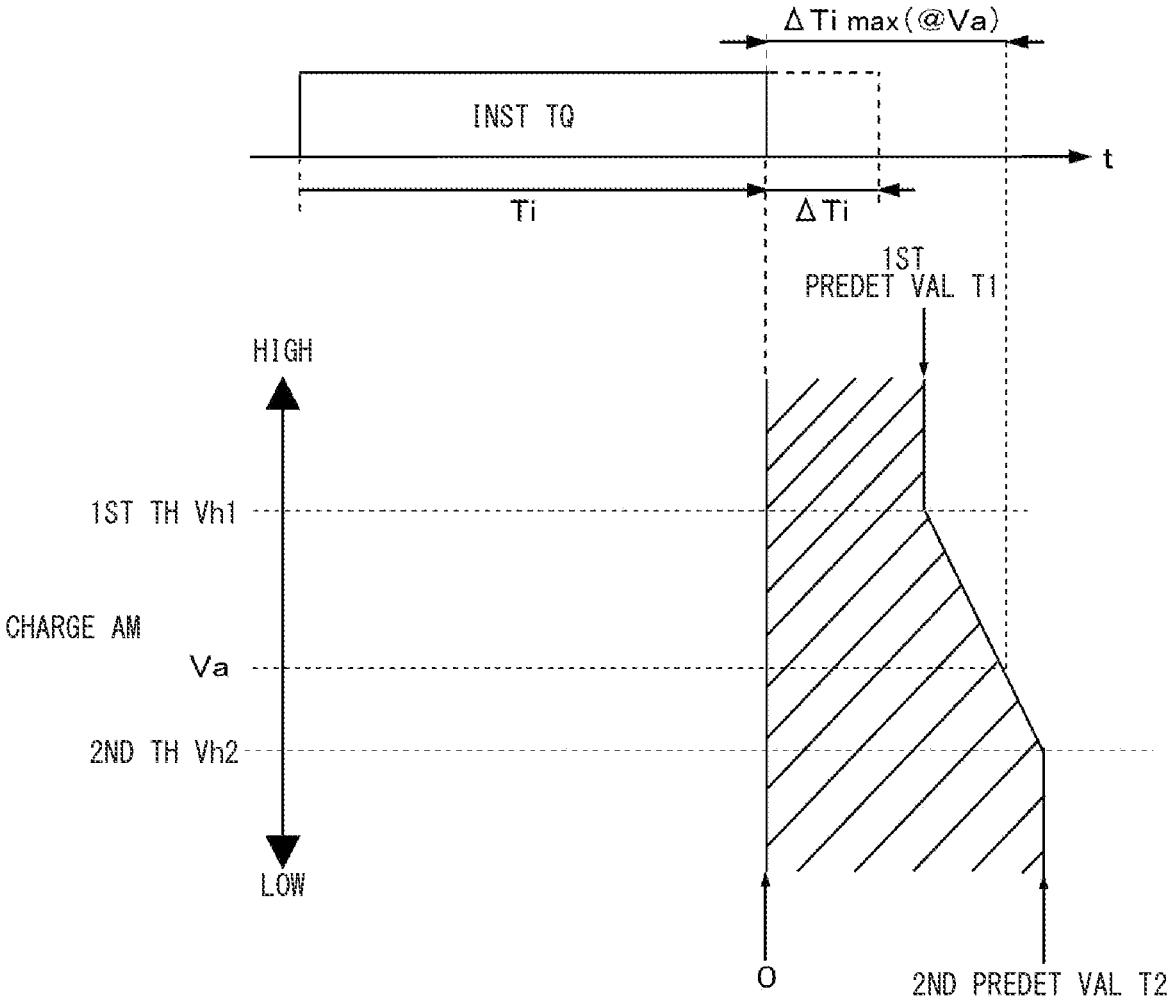
FIG. 5 is an explanatory diagram of a method of setting an upper limit guard value.

The microcomputer 4 determines that the area correction control is necessary if no output abnormality has occurred, acquires the charge amount information in S2, determines whether or not the charge amount corresponds to the first threshold value abnormality, and, when the charge amount is equal to or larger than the first threshold value Vh1, as illustrated in FIG. 5, it may be preferable that the upper limit guard value setting unit 11 sets the upper limit guard value ΔTimax to the first predetermined value T1 which is the lower limit.

Further, when the charge amount is less than the first threshold value Vh1 and equal to or larger than the second threshold value Vh2 which is lower than the first threshold value Vh1, the microcomputer 4 controls to gradually increase the upper limit guard value ΔTimax of the energization time correction amount ΔTi from the first predetermined value T1 to the upper limit value of the second predetermined value T2 which exceeds the first predetermined value T1 while the upper limit guard value setting unit 11 gradually reduces the charge amount from the first threshold value Vh1 to the second threshold value Vh2. FIG. 5 illustrates an upper limit guard value ΔTimax when the charge amount of the charging capacitor 3*a* is defined as Va.

Further, when the charge amount of the charging capacitor 3*a* is less than the second threshold value Vh2 which is lower than the first threshold value Vh1, as illustrated in FIG. 5, the microcomputer 4 controls the upper limit guard value setting unit 11 to set the upper limit guard value ΔTimax to be the second predetermined value T2 that exceeds the first predetermined value T1.

After setting the upper limit guard value ΔTimax in this way, the microcomputer 4 transmits the upper limit guard value ΔTimax to the control IC 5 together with the instruction TQ. When inputting the energization instruction time Ti of the instruction TQ, the control IC 5 controls the energization control unit 5*b* to performs the energization control of the fuel injection valve 2 through the drive circuit 6. On the other hand, the energization time correction amount calculation unit 5*d* of the control IC 5 calculates the energization time correction amount ΔTi by acquiring a current flowing through the fuel injection valve 2 from the current monitor unit 5*c* and performing area correction on the acquired current when the energization control unit 5*b* current-drives the fuel injection valve 2 to cause the fuel injection valve 2 to inject fuel. At this time, the energization time correction amount calculation unit 5*d* calculates the energization time correction amount ΔTi with the upper limit guard value ΔTimax input from the microcomputer 4 as the upper limit.

The energization time correction amount calculation unit 5*d* feeds back the calculated energization time correction amount ΔTi to the energization control unit 5*b*. The energization control unit 5*b* reflects, in real time, the energization time correction amount ΔTi in the energization instruction time Ti of the instruction TQ input corresponding to a certain injection to control energization of the fuel injection valve 2.

The control IC 5 stores, in an internal memory, the nominal current profile PI serving as a target current for the energization current EI and continues peak current control so that the energization current EI reaches a peak current $I_{pk}$ serving as a target by applying the boost voltage Vboost to the fuel injection valve 2 on the basis of the nominal current profile PI under control of the energization control unit 5*b*.

Figure 6:
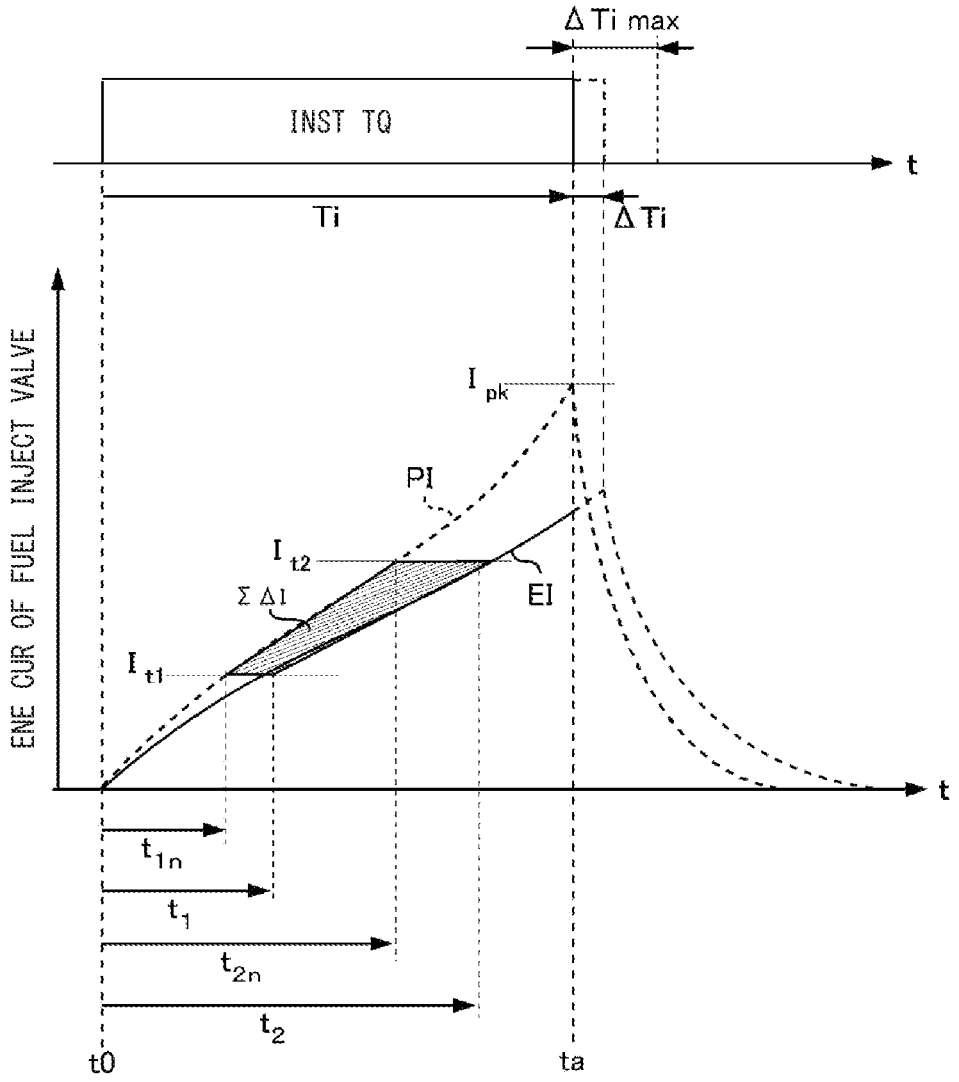
FIG. 6 is an explanatory diagram of a first part of an area correction method.

The control IC 5 continuously applies the boost voltage Vboost to between terminals of the fuel injection valve 2 until the energization current EI reaches the peak current $I_{pk}$ indicated by the nominal current profile PI on the basis of the energization command time of the instruction TQ. The energization current EI of the fuel injection valve 2 rapidly increases to open the fuel injection valve 2. As illustrated in FIG. 6, the energization current EI of the fuel injection valve 2 nonlinearly varies on the basis of the structure of the fuel injection valve 2.

The gradient of the energization current EI becomes lower than the gradient of the nominal current profile PI due to various factors such as a peripheral temperature environment and aged deterioration, and the actual injection quantity becomes smaller than the normal injection quantity based on the nominal current profile PI. Therefore, the control IC 5 calculates the energization time correction amount ΔTi by executing the area correction control and performs feedback control to the energization control unit 5*b* in real time. Specifically, the energization time correction amount calculation unit 5*d* calculates and corrects the integrated current difference between the normal current profile PI and the energization current EI that actually energizes the fuel injection valve 2.

The integrated current difference corresponds to an area surrounded by nonlinear current curves. Thus, in order to calculate the integrated current difference in detail, an operation load tends to increase. Thus, as illustrated in FIG. 6 and represented by Equation (1), the area of a trapezoid with vertices (t, I)=($t_{1n}$, $I_{t1}$), ($t_1$, $I_{t1}$), ($t_{2n}$, $I_{t2}$), ($t_2$, $I_{t2}$) may be regarded as the integrated current difference ΣΔI dependent on the area surrounded by the nonlinear current curves for simple calculation.

[Equation 1]

$$\Sigma\Delta I=\{(t_1-t_{1n})+(t_2-t_{2n})\}\times(I_{t2}-I_{t1})\div 2 \quad (1)$$

The energization time correction amount calculation unit 5*d* calculates the integrated current difference ΣΔI between the nominal current profile PI from ideal arrival time $t_{1n}$ to reach a current threshold $I_{t1}$ to ideal arrival time $t_{2n}$ to reach a current threshold $I_{t2}$ and the energization current EI of the fuel injection valve 2 from arrival time $t_1$ to actually reach the current threshold $I_{t1}$ to arrival time $t_2$ to actually reach the current threshold $I_{t2}$. This enables the energization time correction amount calculation unit 5*d* to simply calculate the integrated current difference ΣΔI by detecting the arrival time $t_1$ to reach the current threshold $I_{t1}$ and the arrival time $t_2$ to reach the current threshold $I_{t2}$. Further, the energization time correction amount calculation unit 5*d* calculates the insufficient energy Ei by multiplying the correction coefficient a by the integrated current difference ΣΔI as shown in the equation (2).

[Equation 2]

$$Ei=\Sigma\Delta I\times\alpha=\{(t_1-t_{1n})+(t_2-t_{2n})\}\times(I_{t2}-I_{t1})\div 2\times\alpha \quad (2)$$

Figure 7:
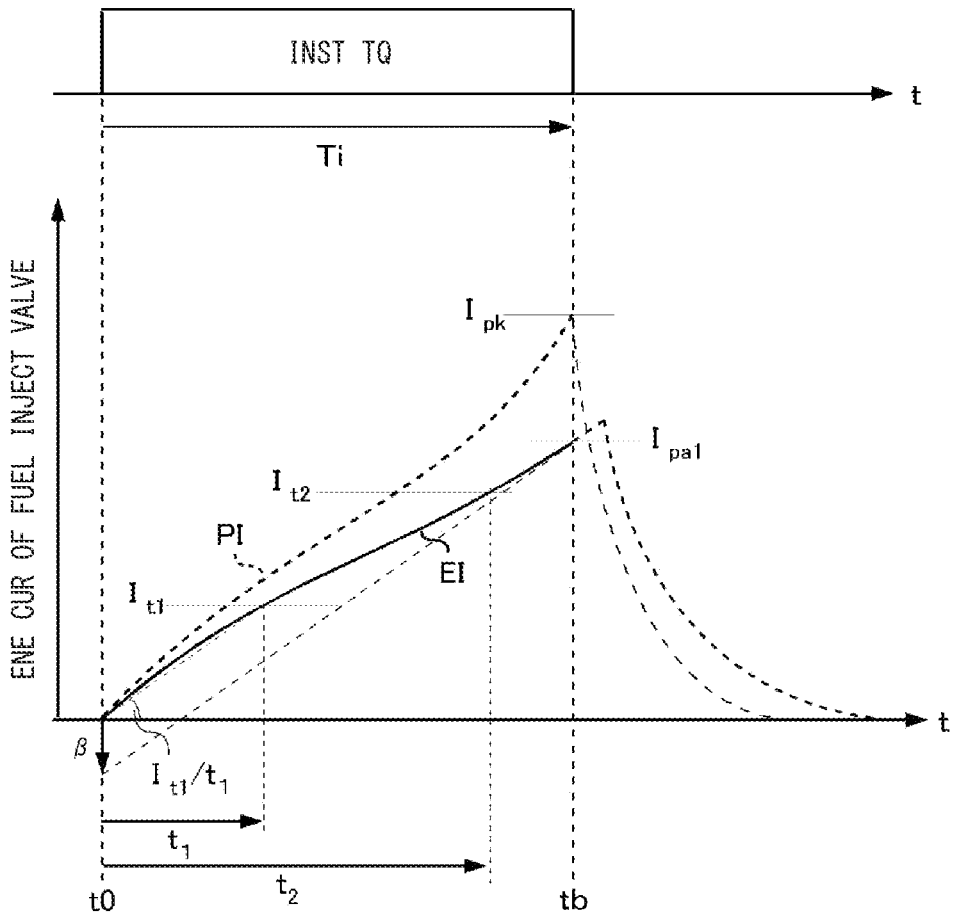
FIG. 7 is an explanatory diagram of a second part of an area correction method.

In Equation (2), the correction coefficient a is used to estimate, from the area of the trapezoid, the energy shortage Ei dependent on an actual integrated current difference and previously calculated according to, for example, the load characteristic of the fuel injection valve 2. As illustrated in FIG. 7, the energization time correction amount calculation unit 5*d* calculates a peak current estimation value $I_{pa1}$ at a point in time when the energization command time Ti indicated by the instruction TQ elapses by calculating a current gradient from the injection start instruction time t0 to the arrival time $t_1$ to reach the current threshold $I_{t1}$ and adding a correction coefficient β thereto as an intercept. The correction coefficient β is a coefficient used for estimating the peak current estimated value $I_{pa1}$ of the injection control, and is a coefficient calculated in advance based on the load characteristics of the fuel injection valve 2 and the like. At this time, the peak current estimation value $I_{pa1}$ may be calculated using Equation (3).

[Equation 3]

$$I_{pa1}=\frac{I_{t1}}{t_1}\times Ti+\beta \quad (3)$$

The correction coefficient β indicates an offset term for accurately estimating the peak current estimated value $I_{pa1}$ at the time of application off timing. Although the current gradient from the injection start instruction time $t_0$ to the arrival time $t_1$ to reach the current threshold $I_{t1}$ is used in the first term of Equation (3), a current gradient from the injection start instruction time $t_0$ to the arrival time $t_2$ to reach the current threshold $I_{t2}$ may be used in the first term of Equation (3).

Next, the energization time correction amount calculation unit 5*d* calculates the energization time correction amount ΔTi for compensating for the energy shortage Ei. Specifically, as represented by Equation (4), the energization time correction amount calculation unit 5*d* calculates the energization time correction amount ΔTi by dividing the calculated energy shortage Ei by the estimated peak current estimation value $I_{pa1}$.

[Equation 4]

$$\Delta Ti=Ei\div I_{pa1}=\frac{\{(t_1-t_{1n})+(t_2-t_{2n})\}\times(I_2-I_1)\div 2\times\alpha}{\frac{I_{t1}}{t_1}\times Ti+\beta}=\frac{\{(t_1-t_{1n})+(t_2-t_{2n})\}\times(I_2-I_1)\times\alpha 2\times t_1}{\{I_{t1}\times Ti\}+\beta\times t_1} \quad (4)$$

α2 in this equation (4) indicates a/2. It is possible to simply calculate an extension time for compensating for the energy shortage Ei and dramatically reduce an operation amount by deriving the energization time correction amount ΔTi using Equation (4) dependent on the energy shortage Ei and the peak current estimation value $I_{pa1}$.

When the energization time correction amount calculation unit 5*d* outputs the calculated energization time correction amount ΔTi to the energization control unit 5*b*, the energization control unit 5*b* corrects the energization command time Ti to an energization command calculated value of the instruction TQ+the energization time correction amount ΔTi as an effective energization command time by timing tb when a current I detected by the current monitoring unit 5*c* reaches the peak current estimation value $I_{pa1}$. This makes it possible to simply correct the energization instruction time Ti of the instruction TQ and extend the energization time. Such a method eliminates the necessity of previously adjusting the energization command time Ti factoring in variations to prevent accidental fire and makes it possible to take measures against accidental fire while minimizing reduction in the fuel efficiency.

The energization time correction amount calculation unit 5*d* calculates the energization time correction amount ΔTi in a period from when the current I reaches the last current threshold $I_{t2}$ to when the current I reaches the peak current estimation value $I_{pa1}$. Thus, the energization instruction time Ti can be corrected with sufficient time. Although a mode in which the energization time correction amount ΔTi is calculated using Equations (1) to (4) has been described, these equations merely show an example, and the present invention is not limited to this method.

Figure 8:
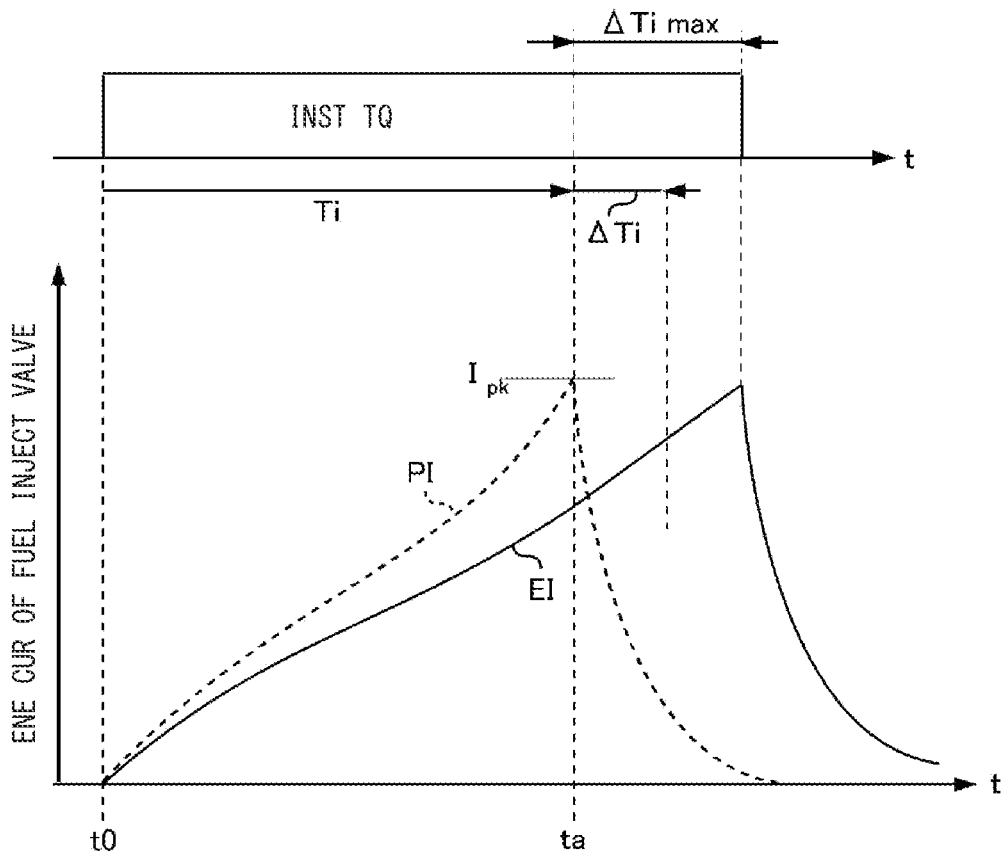
FIG. 8 is a diagram schematically showing a change in energizing current of a fuel injection valve when the upper limit guard value is applied to the maximum.

In order to prevent overcorrection of the energization time correction amount ΔTi while preventing abnormal control by the control IC 5, the microcomputer 4 sets the upper limit guard value ΔTimax of the energization time correction amount ΔTi in advance by the upper limit guard value setting unit 11 and transmits the value ΔTimax to the control IC5. Therefore, as shown in FIG. 8, the control IC 5 can set the energization time correction amount ΔTi with the upper limit guard value ΔTimax of the energization time correction amount ΔTi as the upper limit value, and the in-cylinder injection is not performed with an unintended injection amount setting. As a result, the energization time correction technique can be appropriately operated, and the fuel injection accuracy can be maintained appropriately.

According to the present embodiment, the energization time correction amount calculation unit 5*d* of the control IC 5 changes the area correction control of the energization time correction amount ΔTi by changing the upper limit guard value ΔTimax based on the determination result by the charge amount determination unit 12. Therefore, the energization time correction amount calculation unit 5*d* can change the energization time correction amount ΔTi according to the magnitude of the charge amount, and can supplement the performance of the fuel injection amount correction technique. As a result, the fuel injection accuracy can be appropriately maintained even if the fuel injection amount correction technique cannot sufficiently exert its effect.

Other Embodiments

The present disclosure should not be limited to the embodiments described above, and various modifications may further be implemented without departing from the gist of the present disclosure. For example, the following modifications or extensions are possible. The embodiments described above may be combined as necessary.

Although the mode in which the microcomputer 4 and the control IC 5 are configured as separate integrated circuits has been described, the microcomputer 4 and the control IC 5 may be integrated with each other. In this case, it is preferable to use a high-speed arithmetic processor capable of performing a high-speed operation. In the above embodiments, the present invention is applied to direct injection that directly injects fuel into a combustion chamber of the internal combustion engine. However, the present invention is not limited thereto and may be applied to port injection that injects fuel in front of a known intake valve.

Although the above embodiments describe the mode in which the control IC 5 simply calculates the integrated current difference ΣΔI by calculating the area of the trapezoid of the energization current EI of the fuel injection valve 2, the present invention is not limited thereto. The energization current EI of the fuel injection valve 2 nonlinearly varies both before and after reaching the peak current $I_{pk}$. Thus, it is preferable to simply calculate the integrated current difference by approximately calculating the integrated current using a polygon such as a triangle, a rectangle, or a trapezoid. This makes it possible to dramatically reduce the operation amount.

The means and/or the functions provided by the microcomputer 4 and the control IC 5 can be provided by software recorded in a substantive memory device and a computer executing the software, software only, hardware only, or a combination thereof. For example, when the control device is provided by an electronic circuit as hardware, the control device can include a digital circuit including one or more logic circuits or an analog circuit. Further, for example, when the control device executes various control operations using software, a program is stored in the storage unit, and the control main body executes the program to implement a method corresponding to the program.

The embodiments described above may be combined. In addition, the reference numerals in parentheses described in the claims simply indicate correspondence to the concrete means described in the embodiments, which is an example of the present disclosure. That is, the technical scope of the present invention is not necessarily limited thereto. A part of the above-described embodiment may be dispensed/dropped as long as the problem identified in the background is resolvable. Any aspects conceivable within the nature of the invention specified by wordings described in claims can also be regarded as embodiments.

The present invention has been described in accordance with the embodiment described above. However, it is to be understood that the present invention is not limited to the embodiment and structure. The present disclosure encompasses various modifications and variations within the scope of equivalents. In addition, various modes/combinations, one or more elements added/subtracted thereto/therefrom, may also be considered as the present disclosure and understood as the technical thought thereof.

In the drawing, 1 is an electronic control device (injection control device), 2 is a fuel injection valve, 3 is a booster circuit (charging circuit), 3*a* is a charging capacitor (charging unit), 5*b* is an energization control unit, and 5*d* is an energization time correction amount calculation unit (area correction unit), and 12 indicates a charge amount determination unit.

The controllers and methods described in the present disclosure may be implemented by a special purpose computer created by configuring a memory and a processor programmed to execute one or more particular functions embodied in computer programs. Alternatively, the controllers and methods described in the present disclosure may be implemented by a special purpose computer created by configuring a processor provided by one or more special purpose hardware logic circuits. Alternatively, the controllers and methods described in the present disclosure may be implemented by one or more special purpose computers created by configuring a combination of a memory and a processor programmed to execute one or more particular functions and a processor provided by one or more hardware logic circuits. The computer programs may be stored, as instructions being executed by a computer, in a tangible non-transitory computer-readable medium.

It is noted that a flowchart or the processing of the flowchart in the present application includes sections (also referred to as steps), each of which is represented, for instance, as S1. Further, each section can be divided into several sub-sections while several sections can be combined into a single section. Furthermore, each of thus configured sections can be also referred to as a device, module, or means.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. An injection control device comprising:

an area correction unit that calculates an energization time correction amount by performing area correction control of a current flowing through a fuel injection valve when executing a current drive of the fuel injection valve to inject fuel from the fuel injection valve;

a charging circuit provided with a charging unit and applying an electric power from the charging unit to the fuel injection valve; and a charge amount determination unit for determining the charge amount of the charging unit, wherein:

the area correction unit changes the area correction control based on a determination result of the charge amount determination unit.

2. The injection control device according to claim 1, further comprising:

an upper limit guard value setting unit for setting an upper limit guard value of the energization time correction amount according to the charge amount of the charging unit.

3. The injection control device according to claim 2, wherein:

the upper limit guard value setting unit is configured to:

set the upper limit guard value of the energization time correction amount to be a first predetermined value as a lower limit when the charge amount of the charging unit is equal to or higher than a predetermined first threshold value; and gradually increase the upper limit guard value of the energization time correction amount from the first predetermined value to a second predetermined value which exceeds the first predetermined value while gradually reducing the charge amount from the first threshold value to the second threshold value when the charge amount of the charging unit is less than the predetermined first threshold value and is equal to or higher than the second threshold value which falls below the first threshold value.

4. The injection control device according to claim 2, wherein:

the upper limit guard value setting unit is configured to:

set the upper limit guard value of the energization time correction amount to be the first predetermined value when the charge amount of the charging unit is equal to or higher than the predetermined first threshold value; and set the upper limit guard value of the energization time correction amount to be a second predetermined value which exceeds the first predetermined value when the charged amount of the charging unit is less than the second threshold value that falls below the first threshold value.

5. The injection control device according to claim 1, further comprising:

a determination unit for determining whether to perform the area correction control of the current by the area correction unit, wherein:

the area correction unit is configured to perform the area correction control when the determination unit determines that the area correction control is necessary; and when the determination unit determines that the area correction control is unnecessary, the upper limit guard value setting unit sets the upper limit guard value of the energization time correction amount to be zero.

6. The injection control device according to claim 1, further comprising:

one or more processors; and a memory coupled to the one or more processors and storing program instructions that when executed by the one or more processors cause the one or more processors to provide at least: the area correction unit; the charging circuit; and the charge amount determination unit.

* * * * *